United States Patent [19]

Ranzanigo

[11] 4,071,837

[45] Jan. 31, 1978

[54] FUSE CARTRIDGE

[75] Inventor: Pierluigi Ranzanigo, Brescia, Italy

[73] Assignee: Bassani Ticino S.p.A., Milan, Italy

[21] Appl. No.: 747,538

[22] Filed: Dec. 6, 1976

Related U.S. Application Data

[63] Continuation of Ser. No. 596,082, July 15, 1975, abandoned.

[30] Foreign Application Priority Data

July 26, 1974 Italy ..... 25598/74

[51] Int. Cl.[2] ..... H01H 85/16

[52] U.S. Cl. ..... 337/268; 337/293

[58] Field of Search ..... 337/198, 229, 230, 293, 337/295, 201, 255, 256, 257, 258, 259, 237, 264, 268, 269, 271; 339/19, 147, 207

[56] References Cited

U.S. PATENT DOCUMENTS

| | | | |
|---|---|---|---|
| 2,420,837 | 5/1947 | O'Connor | 337/268 |
| 2,439,674 | 4/1948 | Shuck | 337/293 |
| 3,110,787 | 11/1963 | Borzoni | 337/268 |
| 3,337,705 | 8/1967 | Salzer | 337/256 |

FOREIGN PATENT DOCUMENTS

| | | | |
|---|---|---|---|
| 115,294 | 11/1900 | Germany | 337/268 |

*Primary Examiner*—Harold Broome
*Attorney, Agent, or Firm*—Michael J. Striker

[57] ABSTRACT

A fuse cartridge has a hollow casing of insulated material having an internal chamber filled with quartz sand and being of a parallelepiped form having two transverse walls and two pairs of longitudinal walls. One of the transverse walls is integral with the housing, and the other transverse wall is removable therefrom and has holes, through which electrically conducting pins extend into the chamber. A partition wall is located in the chamber parallel to a plane of symmetry of a first pair of the longitudinal walls. At least one substantially flat fuse strip is located in the chamber and has two opposite ends, each electrically connected to a respective pin. The fuse strip is U-shaped and has two portions parallel to the second pair of the longitudinal walls and a third portion connecting the two portions of the fuse strip to one another and parallel to the transverse walls.

4 Claims, 3 Drawing Figures

FUSE CARTRIDGE

This is a continuation of application Ser. No. 596,082, filed July 15, 1975, now abandoned.

This invention is related to a fuse cartridge of the kind comprising an housing in a stiff insulating material, such as ceramics, enclosing a fuse element, such as a fuse strip merged in finely granulated quartz sand filling the housing recess.

The known fuse cartridges of this kind are provided with a tubolar housing of any cross-section, such as circular, elliptic or rectangular, said cartridge being closed at both its ends by means of conducting caps, to which the fuse strip ends are connected, said caps, in some cases, are provided with axially projecting members to be used for the electrical connection with the external components of an electric circuit.

The main drawback of the above known fuse cartridges is their encumbrance, due really to their elongated shape with the conductive caps at their ends, this encumbrance increasing with the nominal voltage, because the fuse strip length increases with the nominal voltage.

Another drawback is given by the complexity of the construction and consequently by the relatively high cost.

Another further drawback is given by the complexity and by the encumbrance of the seat into which the cartridge has to be inserted.

Said seat, moreover, results also dangerous for the unskilled user, who may be subject to an electrical discharge in the attempt to substitute a melted fuse cartridge. In the attempt to avoid the electrical discharge during the fuse cartridge, it has been proposed to enclose the fuse cartridge into an envelope shaped as a plug connector, provided with connecting pins. Said proposal, however, increases the encumbrance and the cost of the fuse cartridge assembly.

The end of the present invention is to avoid the above cited drawbacks.

The main feature of the fuse cartridge of the invention consists in that the cartridge, in a ceramic material or other insulating material is shaped as a cap provided with an opening only on a wall and containing at least an U-bent fuse strip so disposed to show two portions parallel to the axis of the cap and a transversal portion connecting the first parallel portion, said transversal portion being preferably parallel to the bottom of the cap, and so that the fuse strip is located at a suitable spacement from lateral and bottom walls of the cap, the ends of said fuse strip being near said opening and being connected to a respective pin coming out from this opening, said opening being closed by a movable insulating wall and being provided with holes through which said pins pass, said movable wall acting also as a holding for said pins and as a retaining tap for the quartz sand filling all the cavity of the cap and merging the fuse strip or strips.

According to another embodiment of the invention, the U-bent fuse strip or strips is so located in order to show the transversal portion near the movable wall, not provided with holes in this case, and the ends of the strip or strips near the bottom of the cap, the latter having suitable holes for the passage of the pins connected to said ends.

Another feature of the invention consists in that an insulating partition wall, parallel to the parallel portions of the fuse strip and interposed between said parallel portions, is located into the cap and guided along opposite grooves provided on the internal faces of the cap, said partition wall being spaced from the bottom of the cap, in order to shape the internal cavity of the cap as an U-shaped chamber, which allows the employ of fuse strips of a length suitable for the nominal voltage, notwithstanding the limited length of the cap cartridge.

A further preferred feature of the invention consists in that said cap is in a parallelepiped shape with flat walls, of which only one wall is opened.

Said parallelepiped shape allows to dispose the fuse strip or strips, with the parallel portions, parallel and equispaced with respect to the two opposed walls and to the bottom of the cap, or to the movable wall, and with respect to the two opposed faces of the partition wall, obtaining a transversal encumbrance of the cap less than the encumbrance of any other shape.

A further feature of the invention consists in that the pins coming out from the cartridge are of flattened shape showing large lateral areas, so as the welding of the respective fuse strip end occurs over a large contacting area.

The advantages of such a fuse cartridge are remarkable.

A first advantage is given by the limited encumbrance in all the cartridge directions with respect to the known cartridges, and this independently from the length of the fuse strip or strips contained into the cartridge.

A second advantage is given by the partition wall that avoids the mutual influence of the parallel portions of the fuse strip or strips in the intervention step.

Moreover the cartridge, because of its crouching shape and for the fact that it is insertable by means of two parallel pins directed in the same direction, can be easily inserted and withdrawn into an electrical connecting receptacle, without the danger of electrocutions, as said receptacle may be protected by an insulating cover and may be provided only with two holes for the insertion of the pins.

The same receptacle, moreover, will results of a remarkable limited encumbrance, the cap structure of the cartridge with an open wall obstructed by a movable insulating wall provides a simple assembly composed by a limited number of pieces, of easy and quick assemblage.

Said fuse cartridge, moreover, besides showing appreciable electrical characteristics, is suitable for an high-sery production and at a very reduced cost.

Another advantage, very appreciable, is that, in a same cap, cartridge fuse strips of very different electrical characteristics can be contained, i.e. fuse strips different in the nominal current or tension, by virtue of the appreciable development of the U-shaped chamber, allowing to appreciably reduce the sizes of the cap cartridge for every range or nominal currents or voltages of the fuse strips.

Further, the provision of two parallel pins allows to preset conjugate cross-sections of said pins and of the corresponding holes in the inserting receptacle, so as to render not interchangeable the fuse cartridges for different nominal currents, even employing the same cartridge An embodiment of the invention, as a not-limitative example is shown in the accompanying drawings from which:

Figure 1:
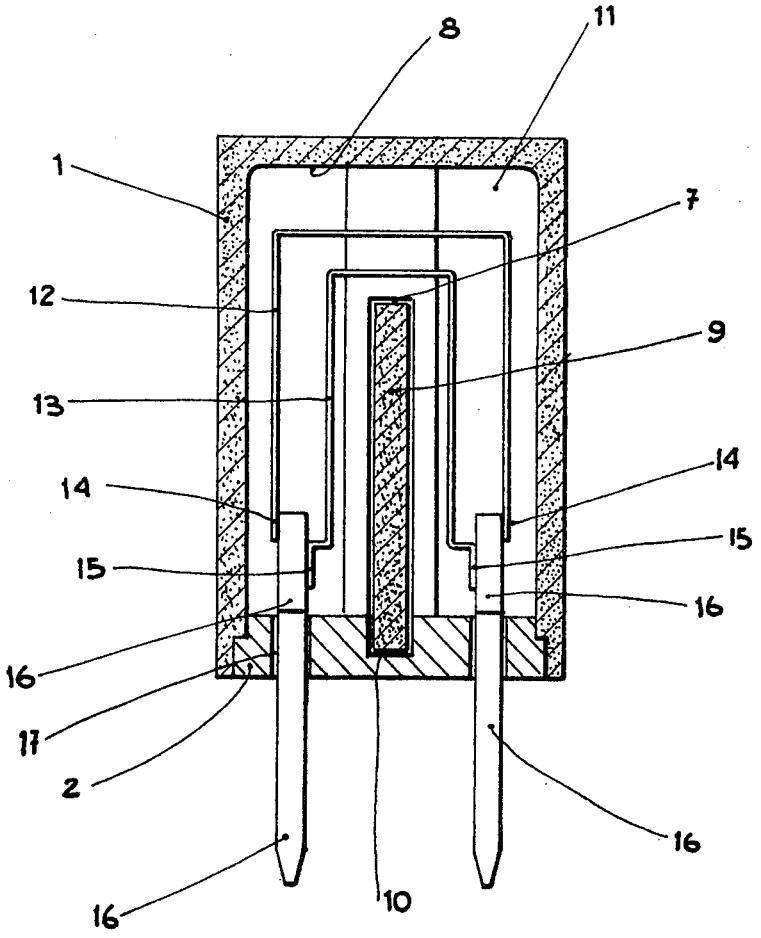
FIG. 1 is an elevation view, in axial cross-section, of the cartridge of the invention, in an enlarged scale.
Figure 2:
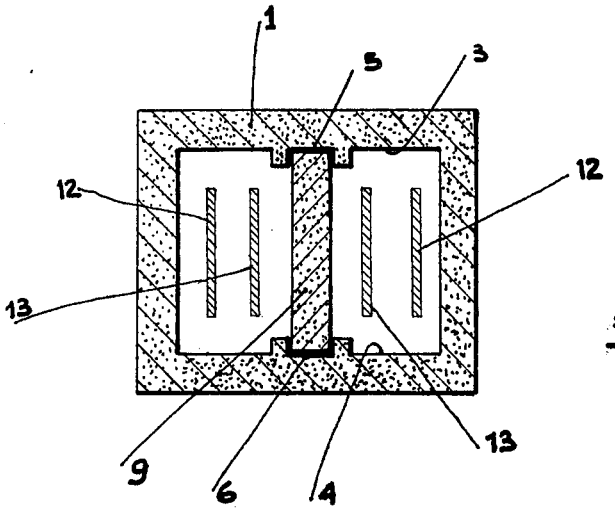
FIG. 2 is a top section view.

Referring to FIGS. 1 and 2, the fuse cartridge of the invention provides a cartridge 1 of highly insulating stiff material, such as ceramic or plastic material, having the shape of a recessed, preferably parallelepiped, cap, opened on a face that can be obstructed by means of a movable wall 2 of insulating material, not necessarily stiff.

Inside the cap 1, on the two opposed walls 3 and 4, and along the middle plane, there are provided respective guide grooves 5 and 6 (FIG. 2), ending on an abutment 7 spaced from the bottom wall 8 of the same cap. Along said guide grooves is located a partition wall 9 held between the abutment 7 and a seat provided by the movable wall 2, so as, inside the cartridge 1, an U-shaped chamber 11 is generated, having the width about constant along all its development.

In the case of the parallelepiped shaped cartridge, this U-shaped chamber 11 is limited among parallel flat walls and results of rectangular cross-section that may be maintained about constant spacing adequately the partition wall 9 from the bottom wall 8.

Into the U-shaped chamber 11, two fuse strips 12 and 13 are disposed parallel each other and U-bent, in order to follow the development of the U-shaped chamber 11 and having their ends, respectively 14 and 15, near the movable wall 2.

The ends 14 and 15 of a same side, are welded to a respective pin 16 that goes out from the cartridge, passing through a respective hole 17 of the movable wall 2 and projecting forward.

The welding of the ends 14 and 15 is executed so that the two fuse strips 12 and 13 are maintained spaced and parallel each other, along all the development of the U-shaped chamber 11.

Naturally the U-shaped chamber 11 is filled with quartz sand merging the fuse strips 12 and 13, said quartz sand being prevented to leak out from the movable wall 2, so that said movable wall 2 has the function to hold the pins 16 and to retain the quartz sand.

Instead of two fuse strips, as shown in FIGS. 1 and 2, a sole fuse strip may be employed located, preferably, along the half of the U-shaped chamber 11.

It has to be noted, particularly from FIG. 1, in what a manner, notwithstanding the crouching shape of the cartridge 1, said U-shaped chamber 11 shows an appreciable development having a length longer than twice the height of the cartridge, so that into said U-shaped chamber 11, fuse strips of appreciable length may be located and this notwithstanding, the encumbrance of the fuse cartridge is very reduced with respect to the known fuse cartridges into which the fuse strips are located in a straight position.

Further it may be noted from FIG. 1 that the pins 16, being projected and parallel from a same side, may be easily inserted and withdrawn with respect to a receptacle, the components of which under tension are protected by an insulating cover, having holes for the insertion of said pins. This possibility, with the fact that the cartridge may be easily handled by the user, allows to handle the same cartridge with an high security.

Further it has to be noted from FIG. 1 that, shaping the cross section of the pins and of the holes of said protecting cover, the fuse cartridge may be rendered not interchangeable in order to prevent that, in a particular electrical circuit, fuse elements would be inserted having nominal current and the voltage of said electrical circuit.

This means that a same insulating cartridge 1 may be employed for containing fuse strips of different nominal current or voltage, but using pins of different cross-sections with the advantage that a same insulating cartridge is used for a large range of nominal currents or voltages.

The pins 16 are preferably of flattened shape, so that the ends 14 and 15 of the fuse strips 12 and 13 may be welded on said pins over a large contacting area, limiting the resistance of the contact.

Though the parallelepiped shape of the cartridge is preferred, into the field of the invention all the cartridges are comprised having the shape of a cap, opened on a sole wall, and having a different cross-section, for example cylindrical, prismatic and with the bottom wall flat or externally convex.

Figure 3:
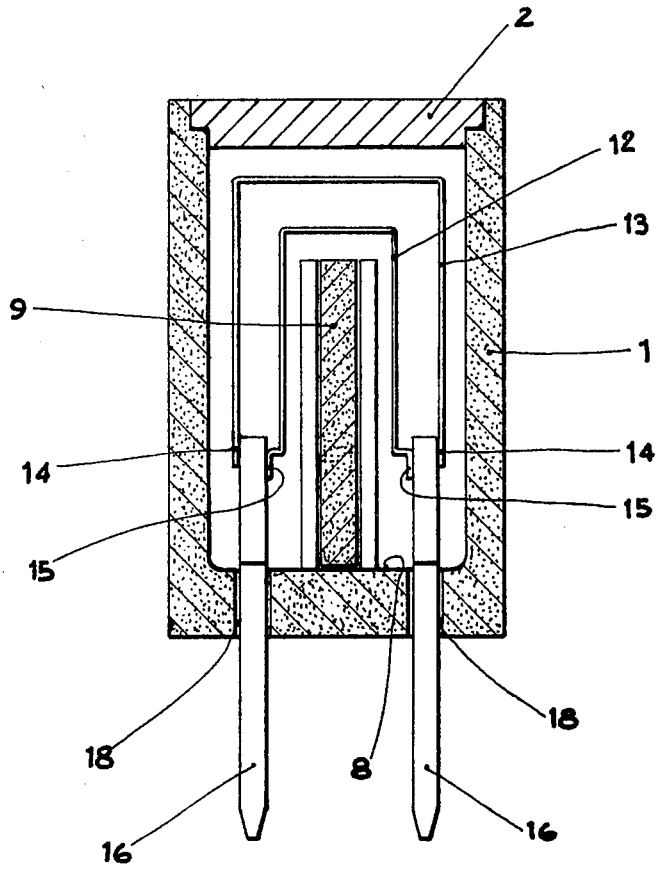
FIG. 3 is a section of a variation of the embodiment of FIG. 1.

In the variation of FIG. 3, the fuse strips 12 and 13 are so positioned that their ends 14 and 15 are directed toward the bottom 8 while their transversal portions are disposed near the movable wall 2, that, in this case, is without holes.

On the contrary the bottom 8 of the cap is provided with holes 18 through which the pins 16 may be projected outside.

In this variation is also provided the partition wall 9 located into guide grooves that allow said partition wall to abut up to the bottom 8, although being spaced adequately from the movable wall 2.

The variation of FIG. 3 shows all the advantages of the cartridge of FIG. 1 being provided of the same structure and being composed by the same elements.

It has to be understood that changes and modifications may be made of several parts of the fuse cartridge shown and described, without departing from the scope of this invention.

I claim:

1. Fuse cartridge, comprising a hollow casing of insulated material having an internal chamber filled with quartz sand and being of a parallelpiped form having two transverse walls and two pairs of longitudinal walls normal to said transverse walls, a first of said transverse walls being integral with and a second of said transverse walls being removable from said casing, and one of said transverse wall being provided with holes; electrically conducting pins each having one end extending through a respective one of said holes into said chamber; a partition wall located in said chamber and extending substantially along a longitudinal plane of symmetry of said first pair of said longitudinal walls; and at least two flat fuse strips located in said chamber and each having two opposite ends each electrically connected to said one end of a respective one of said pins, said fuse strips being U-shaped and each further having two portions substantially parallel to said second pair of said longitudinal walls and connected to each other by means of a third portion extending adjacent to said second transverse wall and substantially parallel thereto, said fuse strips being located substantially parallel to one another so that one of said fuse strips is inwardly spaced from and outwardly embraced by the other fuse strip, each of said two portions of said one of said fuse strips being spaced from said partition wall, and each of said two portions of said other fuse strip being spaced from each of said second pair of said longitudinal walls at a constant distance.

2. Fuse cartridge comprising a hollow casing of insulating material having an internal chamber filled qith quartz sand and being of parallelpiped form having two transverse walls and two pairs of longitudinal walls normal to said transverse walls, each of said walls having a flat inner and a flat outer surface, a first of said transverse walls being integral with and a second of said transverse walls being removable from said casing, and one of said transverse walls being provided-with holes; electrically conducting pins each having one end extending through a respective one of said holes into said chamber; at least two substantially flat fuse strips located in said chamber and each having two opposite ends each electrically connected to said one end of the corresponding pin, said fuse strips being U-shaped and nested within each other, each fuse strip having two portions substantially parallel to the flat inner surfaces of one of said pairs of longitudinal walls and connected to each other by means of a third portion extending adjacent to the flat inner surface of said second transverse wall and substantially parallel thereto.

3. The fuse cartridge as defined in claim 2, wherein said first transverse wall integral with said casing is configurated as a bottom wall and has said holes, said second transverse wall removable from said housing being configurated as a top wall, said fuse strip is positioned so that its ends are located adjacent said bottom wall and connected to said pins extending through said holes in the bottom wall and its third portion extends adjacent to said top wall.

4. The fuse cartridge as defined in claim 2, wherein the other pair of longitudinal walls is provided with grooves extending substantially along an axis of symmetry of said other pair of said longitudinal walls; and further comprising a detachable partition wall located in said chamber and received in said grooves intermediate said two portions of said fuse strip and parallel thereto.

* * * * *